US008861766B2

(12) United States Patent
Ouryouji

(10) Patent No.: US 8,861,766 B2
(45) Date of Patent: Oct. 14, 2014

(54) HEADPHONES

(75) Inventor: Makoto Ouryouji, Yokohama (JP)

(73) Assignee: Victor Company of Japan, Ltd., Kanagawa-Ku, Yokohama-Shi, Kanagawa-Ken (JP)

( * ) Notice: Subject to any disclaimer, the term of this patent is extended or adjusted under 35 U.S.C. 154(b) by 1453 days.

(21) Appl. No.: 12/217,469

(22) Filed: Jul. 3, 2008

(65) Prior Publication Data

US 2009/0010474 A1 Jan. 8, 2009

(30) Foreign Application Priority Data

Jul. 4, 2007 (JP) ..... 2007-176009

(51) Int. Cl.

*H04R 25/00* (2006.01)
*H04R 1/10* (2006.01)
*H04R 5/033* (2006.01)

(52) U.S. Cl.

CPC ..... *H04R 1/1083* (2013.01); *H04R 5/033* (2013.01); *H04R 1/1058* (2013.01); *H04R 1/1075* (2013.01); *H04R 1/1066* (2013.01)
USPC ..... 381/370; 381/374; 381/375

(58) Field of Classification Search

None
See application file for complete search history.

(56) References Cited

U.S. PATENT DOCUMENTS

| | | | | |
|---|---|---|---|---|
| 3,984,885 | A * | 10/1976 | Yoshimura et al. | 381/309 |
| 4,058,688 | A * | 11/1977 | Nishimura et al. | 381/372 |
| 7,466,838 | B1 * | 12/2008 | Moseley | 381/370 |
| 8,180,092 | B2 | 5/2012 | Grell et al. | |
| 8,483,422 | B2 * | 7/2013 | Welker et al. | 381/388 |
| 2005/0213774 | A1 | 9/2005 | Kleinschmidt et al. | 381/71.6 |
| 2006/0104471 | A1 * | 5/2006 | Tsunoda et al. | 381/374 |
| 2007/0154046 | A1 * | 7/2007 | Mishan | 381/370 |
| 2008/0253604 | A1 * | 10/2008 | Yamagishi et al. | 381/379 |
| 2009/0010474 | A1 * | 1/2009 | Ouryouji | 381/370 |
| 2009/0226023 | A1 * | 9/2009 | Akino | 381/374 |
| 2010/0067714 | A1 * | 3/2010 | Cheng | 381/74 |
| 2010/0310093 | A1 * | 12/2010 | Semcken | 381/104 |

FOREIGN PATENT DOCUMENTS

| | | | |
|---|---|---|---|
| JP | 02-095139 | | 4/1990 |
| JP | 3-122474 | | 12/1991 |
| JP | 5-36991 | | 5/1993 |
| JP | 05-292589 | | 11/1993 |
| JP | 2000-089766 | | 3/2000 |
| JP | 2001-211491 | | 8/2001 |
| JP | 2001-267761 | | 9/2001 |
| JP | 2003-179990 | | 6/2003 |
| JP | 2009017175 | A * | 1/2009 |
| JP | 2009278166 | A * | 11/2009 |

* cited by examiner

*Primary Examiner* — Marlon Fetcher
(74) *Attorney, Agent, or Firm* — Renner, Kenner, Greive, Bobak, Taylor & Weber

(57) ABSTRACT

A headphone set has at least one speaker section. The speaker section includes a baffle having at least one sound emitting hole, a surrounding wall formed on the baffle so that the surrounding wall protrudes from the baffle and surrounds the sound emitting hole, a speaker unit installed within the surrounding wall and having a first surface to face the sound emitting hole and an opposite second surface, a unit case provided as touching the surrounding wall and covering the second surface of the speaker unit, a first cavity existing as enclosed by the unit case and the second surface of the speaker unit, and a housing provided as touching the baffle and covering the unit case, a second cavity existing as enclosed by the housing, the unit case, and the baffle.

6 Claims, 15 Drawing Sheets

HEADPHONES

CROSS-REFERENCE TO RELATED APPLICATIONS

This application is based on and claims the benefit of priority from the prior Japanese Patent Application No. 2007-176009 filed on Jul. 4, 2007, the entire contents of which is incorporated herein by reference.

BACKGROUND OF THE INVENTION

The present invention relates to headphones, and, especially, the technology feasibly applied to passive headphones and also active headphones equipped with a battery, exhibiting a high sound insulation performance against ambient noises.

The widespread of portable music players has brought rapid expansion of the market of headphones to be connected to the players.

Headphones are roughly classified into an inner-ear type inserted into the auricles of a user and an overhead type with a headband put on the head and soft pads attached to or covering the auricles.

The overhead type is advantageous over the inner-ear type for its much larger size of speakers and speaker housings because the weight of headphones is mainly borne by the head of a user via a headband, thus providing higher sound quality.

With the expansion of the market of headphones, the overhead type headphones, which used to be used mainly in a room, have been used in a variety of circumstances, for example, in a vehicle, such as, a train, a bus, an aircraft, etc., or while waiting for someone outside.

These circumstances give a much high level of ambient noises. The sound quality in a circumstance of a high level of ambient noises is thus the subject to improvements, which leads to the demand for headphones with a higher sound insulation performance.

One technique to enhance the sound quality against ambient noises is a noise-canceling function. And, headphones, so-called noise-canceling headphones having the noise-canceling function have been in the spotlight recently.

The noise-canceling headphones are equipped with: a microphone installed in a housing to receive ambient noise components generated around the headphones; and noise-reducing circuitry to generate signals with the opposite polarity of the ambient noise components, combine the opposite-polarity signals with audio signals, and output the combined signals through speakers. The noise-canceling headphones are thus active headphones that make listeners feel that noises are reduced with "opposite-polarity cancellation effects" to the ambient noises.

Another type of known noise-canceling headphones is equipped with: a microphone provided between an ear of a user and a speaker to directly receive sounds that include ambient noises components and are to be given off to the ear; and feedback noise-reducing circuitry to detect the ambient noises components from the difference between the received sounds and an original signal and output audio signals from which the ambient noises components are subtracted, thus reducing the ambient noises components.

The former using the opposite-polarity cancellation effects is called a feed forward type whereas the latter using the feedback circuitry is called feedback type.

Noise-canceling headphones are generally equipped with a power supply, such as, a battery.

With change in circumstances or conditions for the use of headphones, the use of noise-canceling headphones has been spread, not only for enjoying music through speakers but also for sound insulation, as a sound-insulating apparatus, while a user is sleeping in a vehicle, such as, a plane.

When the noise-canceling headphones are used as a sound-insulating apparatus, the noise-reducing circuitry only functions, while no audio signals of music, etc. is being output, to output audio signals with the opposite polarity of ambient noise components, thus making a user feel that ambient noises are reduced.

Accordingly, when used as a sound-insulating apparatus, the noise-canceling headphones provide a user a comfortable sleeping condition with very low ambient noises even in a circumstance with large ambient noises, which is very useful or helpful for passengers of a vehicle with large engine noises, such as, a jet plane.

The noise-canceling headphones exhibit a high ambient-noise reduction performance when the noise-reducing circuitry is functioning. However, the performance is very poor like the passive type when the noise-reducing circuitry is not functioning. The noise-canceling headphones consume the battery a lot when the noise-reducing circuitry is functioning for long hours for a user to sleep, which requires battery replacement often. Then, the user has to carry new batteries, which is very bothersome when he or she is on a trip.

There is thus a strong demand for the noise-canceling headphones exhibiting an ambient-noise reduction performance even though the noise-reducing circuitry is not functioning.

It is also very useful for the passive type (not the noise-canceling type) if it exhibits such an ambient-noise reduction performance even though there is no output audio signals, which can offer a comfortable sleeping condition in a vehicle, such as, a plane.

SUMMARY OF THE INVENTION

A purpose of the present invention is to provide headphones that exhibit a high sound insulation performance to effectively reduce ambient noises.

The present invention provides a headphone set comprising at least one speaker section, the speaker section including: a baffle having at least one sound emitting hole; a surrounding wall formed on the baffle so that the surrounding wall protrudes from the baffle and surrounds the sound emitting hole; a speaker unit installed within the surrounding wall and having a first surface to face the sound emitting hole and an opposite second surface; a unit case provided as touching the surrounding wall and covering the second surface of the speaker unit, a first cavity existing as enclosed by the unit case and the second surface of the speaker unit; and a housing provided as touching the baffle and covering the unit case, a second cavity existing as enclosed by the housing, the unit case, and the baffle.

DETAILED DESCRIPTION OF PREFERRED EMBODIMENT

A preferred embodiment of headphones according to the present invention will be described with reference to FIGS. 1 to 12.

Figure 1:
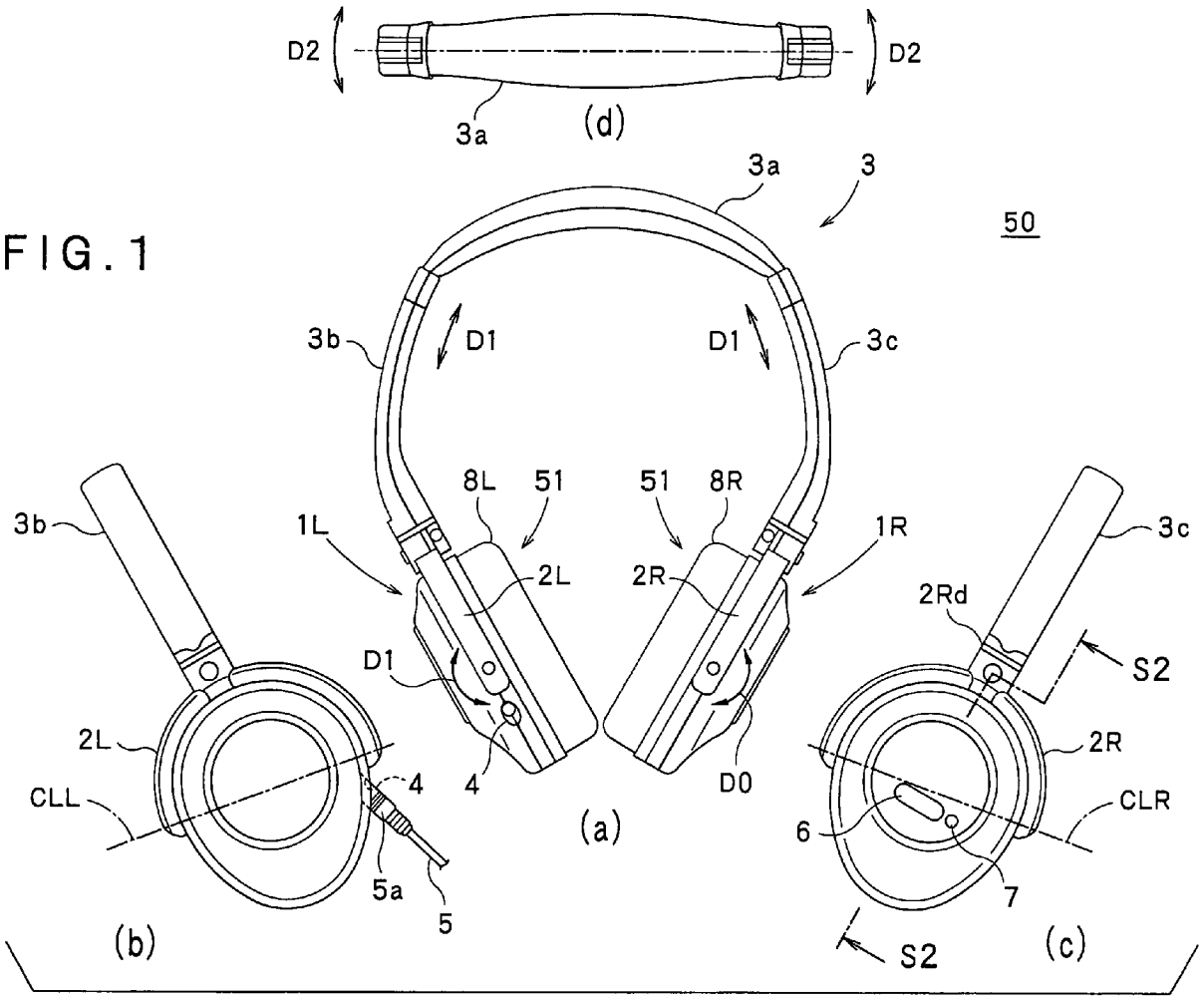
FIG. 1 shows an appearance of headphones, a preferred embodiment according to the present invention.

Illustrated in FIG. 1 is an appearance of a headphone set 50, a preferred embodiment according to the present invention, in which (a), (b), (c) and (d) are a front view, a left side view, a right side view, and a top view, respectively.

The headphone set 50 is equipped with: a left speaker section 1L; a right speaker section 1R; a left hanger section 2L that hangs the left speaker section 1L so that the section 1L can be rotated about an axis CLL in the directions indicated by allows D0 within a specific angle; a right hanger section 2R that hangs the right speaker section 1R so that the section 1R can be rotated about an axis CLR in the directions indicated by allows D0 within a specific angle; and a headband section 3 that connects the left and right hanger sections 2L and 2R to each other.

The headband section 3 is equipped with a base 3*a* and arms 3*b* and 3*c* provided on both sides of the base 3*a* so that each arm can be slid into and out of the base 3*a* in the directions indicated by allows D1.

The hanger sections 2L and 2R are coupled to the arms 3*b* and 3*c*, respectively, so that each hanger section can be rotated in the directions indicated by allows D2.

In use of the headphone set 50, a user puts the headband section 3 on his or her head and adjusts the position and/or direction of the left and right speaker sections 1L and 1R in the directions D0, D1 and D2. The adjustments allow the user to make the speaker sections 1L and 1R fit on his or her ears irrespective of his or her head shape and the positions of the ears.

The left speaker section 1L has a jack 4 for electronic connection with external audio equipment. Illustrated in (b) of FIG. 1 is a plug 5*a* of a signal cable 5 attached to the jack 4. Connected to the other end of the cable 5 is audio equipment, such as, CD (Compact Disc) player and a portable music player, audio signals output from the audio equipment being supplied to the headphone set 50 through the cable 5.

Provided to the right speaker section 1R are: a power switch 6 that turns on or off an ambient-noise reducing circuit NCC installed in the speaker section 1R, which will be described later; and an LED 7 that is an power indicator to be on when the circuit NCC is on.

Moreover, the left and right speaker sections 1L and 1R have pads 8L and 8R, respectively, to be attached to the auricles of a user. The pads 8L and 8R are formed softly with low-foamed uretan foam covered by resin leather, which will be described later in detail.

The structure of the headphone set 50 is explained with reference to an exploded view in FIG. 2.

The left and right speaker sections 1L and 1R of the headphone set 50 have roughly the same structure, or almost the symmetrical structure, except for some specific parts.

Although the detailed features are different, the left and right speaker sections 1L and 1R have the following common parts: baffles 11L and 11R; unit cases 12L and 12R attached to the baffles 11L and 11R, respectively; circuit boards 13L and 13R; microphones 14L and 14R; housings 15L and 15R (that house the microphones 14L and 14R, respectively) attached to the baffles 11L and 11R, respectively; ear-pad holders 9L and 9R attached to the baffles 11L and 11R, respectively, on the opposite of the housings 15L and 15R, respectively; and pads 8L and 8R attached to the ear-pad holders 9L and 9R, respectively. Moreover, integrally attached to the unit cases 12L and 12R are speaker units 16L and 16R, respectively.

The different structures between the left and right speaker sections 1L and 1R are as follows:

The left speaker section 1L is equipped with a jack section JK having the jack 4 and attached to the baffle 11L.

Figure 8:
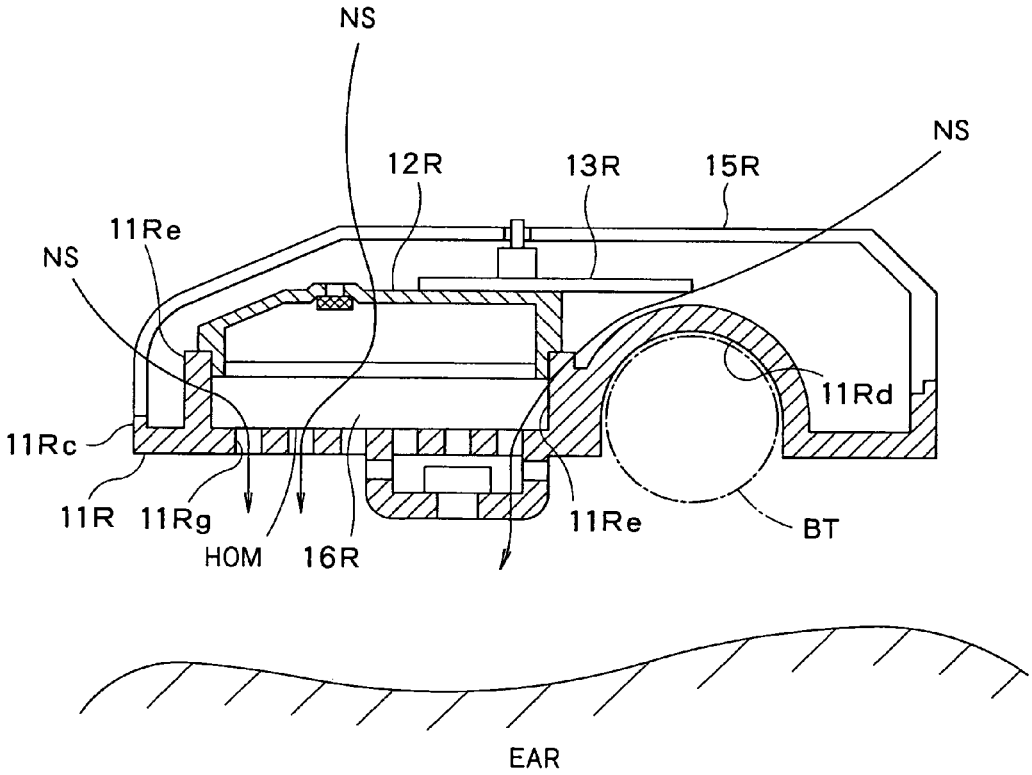
FIG. 8 shows a sectional view illustrating a modification to the headphones, the embodiment according to the present invention.

The baffle 11R of the right speaker section 1R is provided with a battery container 11Rd that contains a AAA dry battery. Provided to the left speaker section 1L is a dummy battery container 11Ld that has the same shape as the container 11Rd, as shown in (c) of FIG. 3. A battery BT is installed in the battery container 11Rd only, in use of the headphone set 50, as shown in FIG. 8.

The right hanger section 2R, formed roughly in a reverse-"Y" shape, consists of a hanger 2Ra and a hanger cover 2Rb, with an internal signal wiring SL. Formed at the tips of the reverse-"Y"-shaped arms of each of the hanger 2Ra and hanger cover 2Rb are dowels 2Rc sticking out as facing each other.

The unit case 12R, the circuit board 13R and the housing 15R are fixed to the baffle 11R with tapping screws NJ. The microphone 14R is installed in a microphone container 11Ra provided in the baffle 11R, as shown in (a) of FIG. 3.

The pad 8R is attached to the pad holder 9R on the outer edge of the holder 9R. And, the pad 8R and the pad holder 9R are detachably attached to the baffle 11R with a snap-fit connection, which will be described later.

The baffle 11R has a pair of through holes 11Rb with the common center axis along the baffle surface. The dowels 2Rc of the right hanger section 2R are inserted into the through holes 11Rb of the baffle 11R so that the right speaker section 1R and the right hanger section 2R are coupled to each other.

The arm 3*c* of the headband section 3 is inserted into the right hanger section 2R at a base 2Rd of the reverse-"Y"-shape, as shown in (c) of FIG. 1, so that the right hanger section 2R is coupled to the headband section 3.

The left speaker section 1L is coupled to the headband section 3 with a similar mechanism as the right speaker section 1R.

Described next are the signal and power network of the headphone 50.

Figure 2:
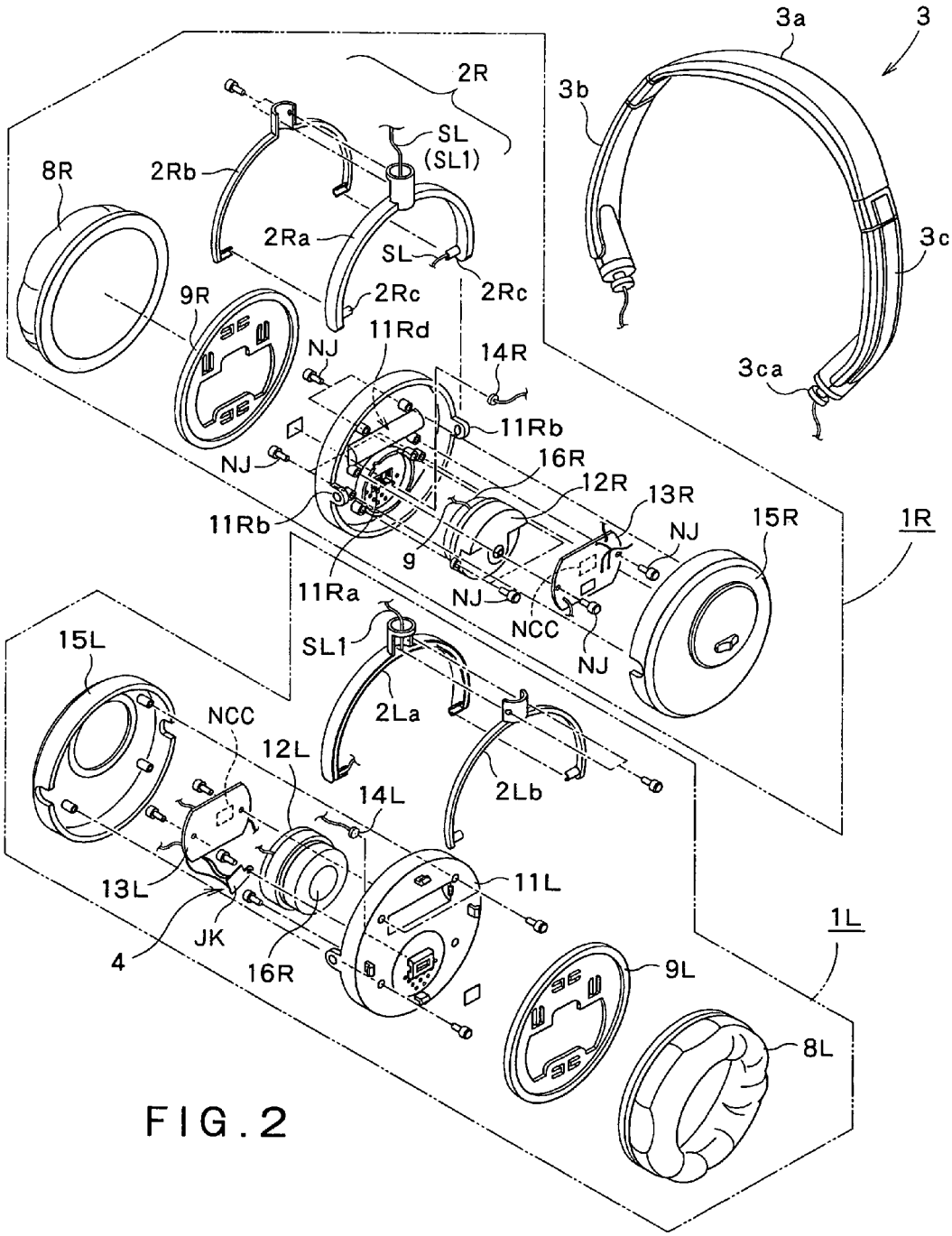
FIG. 2 shows an exploded view of the headphones, the embodiment according to the present invention.

Wiring shown in FIG. 2 is not the entire wiring but just a part, such as, the signal wiring SL, for brevity. The wiring is made so that signals, such as, audio signals are input and output, as described below.

In an audio signal input from external equipment to the headphone set 50 via the jack 4, a left-channel signal component is supplied to the circuit board 13L whereas a right-channel signal component is supplied to the circuit board 13R through the signal wiring SL provided in the left hanger section 2L, the headband section 3, and the right hanger section 2R.

Audio signals received by the microphones 14L and 14R are supplied to the circuit boards 13L and 13R, respectively. The circuit boards 13L and 13R then supply audio output to the speaker units 16L and 16R, respectively.

Power is supplied to the circuit boards 13L and 13R from the battery BT contained in the battery container 11Rd, especially, to the board 13L through signal wiring SL1 provided in the headband section 3.

Described is the ambient-noise reducing circuit NCC. The circuit boards 13L and 13R are equipped with the identical circuits NCC.

Although the following description is made for the ambient-noise reducing circuit NCC at the circuit board 13R, which is also applied to the circuit NCC at the board 13L.

Figure 4:
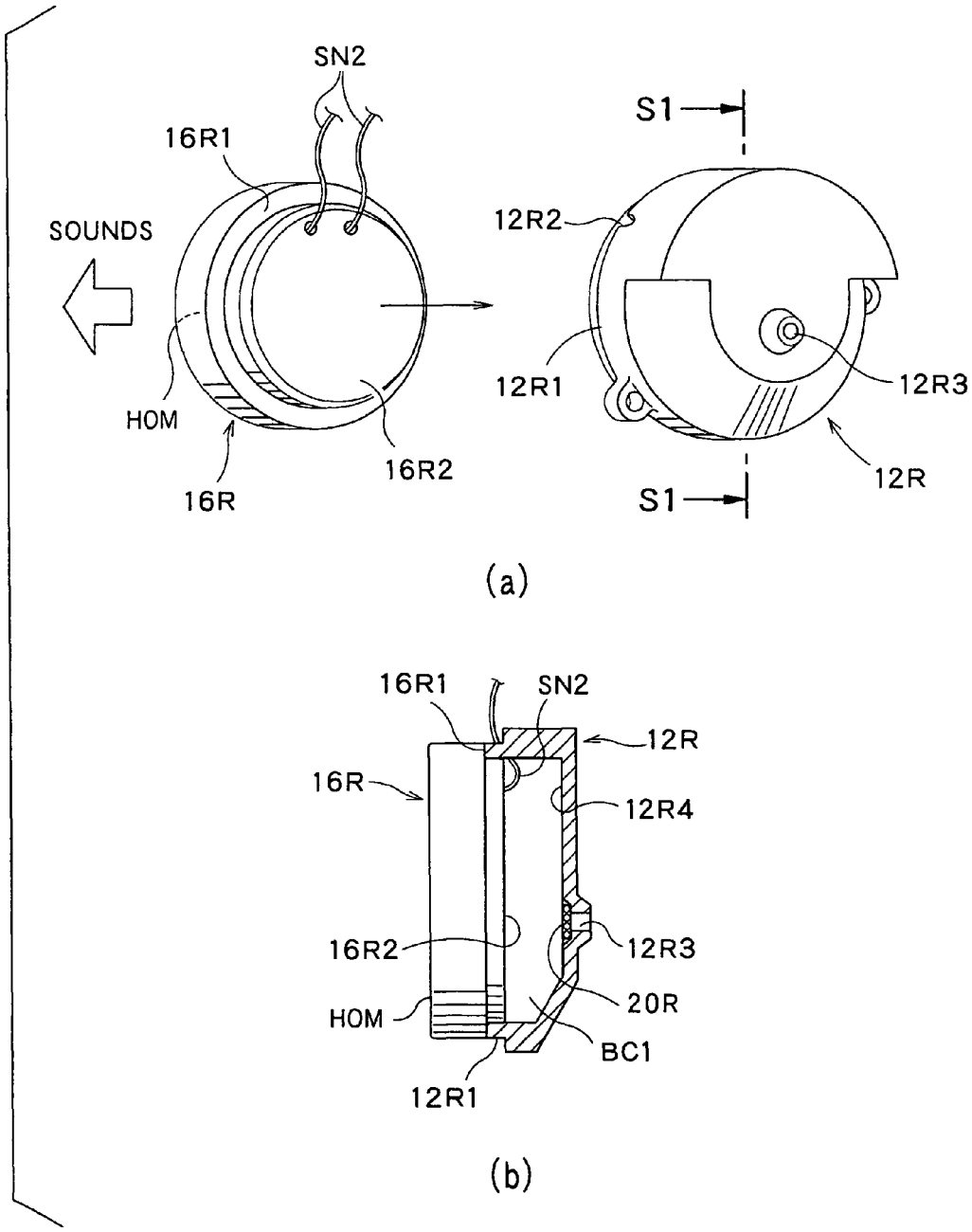
FIG. 4 shows a speaker unit and the corresponding unit case of the headphones, the embodiment according to the present invention.

The ambient-noise reducing circuit NCC at the circuit board 13R generates a differential signal that is the difference between a first audio signal supplied to the speaker unit 16R and a second audio signal received by the microphone 14R contained in the microphone container 11Ra provided near a sound emitting surface HOM, shown in (a) of FIG. 4. The audio signal received by the microphone 14R carries almost the same sounds as a user hears.

Then, the ambient-noise reducing circuit NCC generates an opposite-polarity differential signal with the opposite polarity of the differential signal, combines the opposite-polarity differential signal and the first audio signal, and supplies the combined audio signal to the speaker unit 16R.

The combined audio signal output from the speaker unit 16R and ambient noises are received by the microphone 14R, as the second audio signal. Generated again is a differential signal that is the difference between the first audio signal, or the combined audio signal, supplied to the speaker unit 16R and the second audio signal, or the combined audio signal (output from the speaker unit 16R) and the ambient noises received by the microphone 14R. The differential signal is repeatedly generated in the feedback system so that the ambient noises are effectively reduced.

Described next is the detailed internal structure of the right speaker section 1R.

Figure 3:
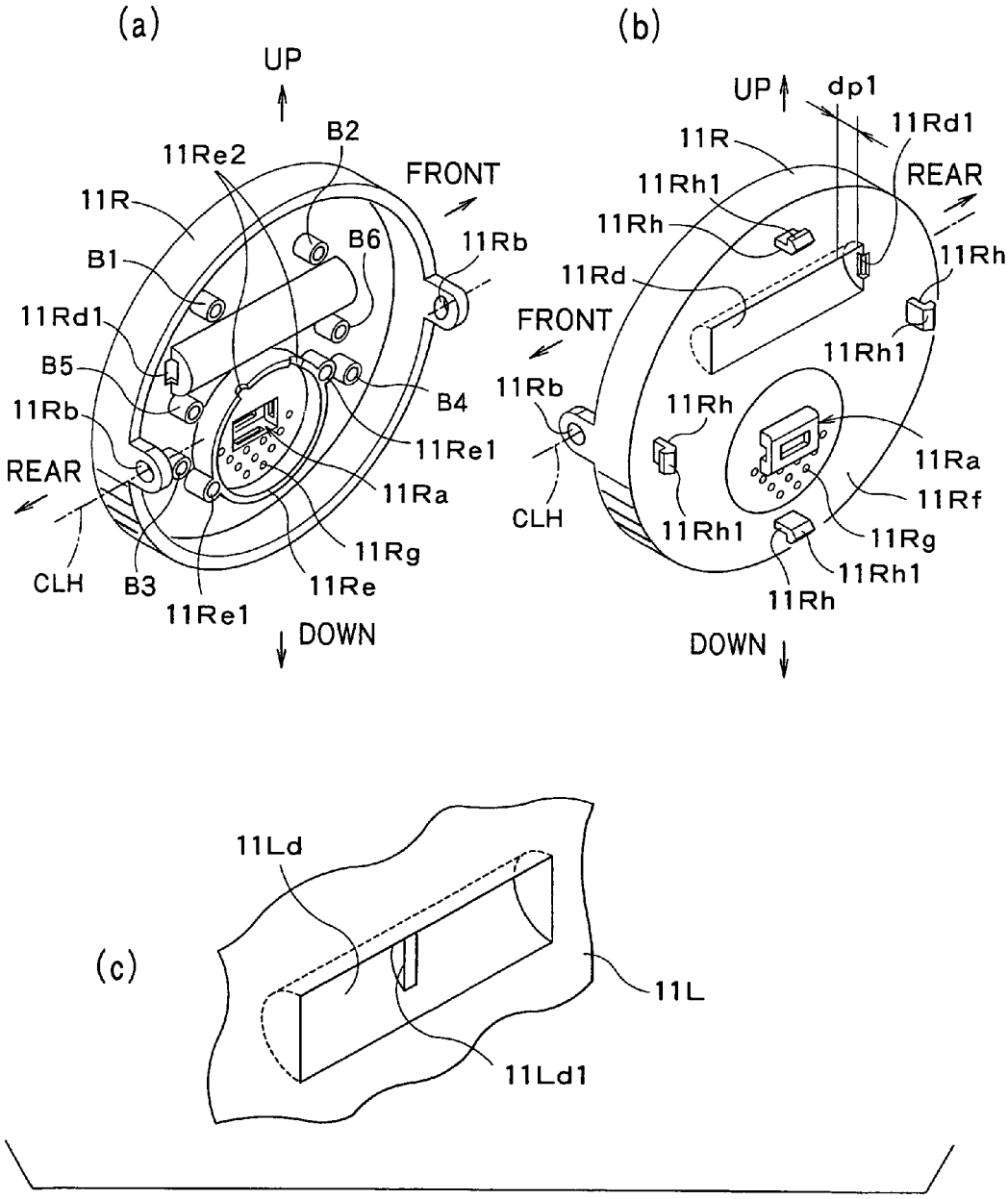
FIG. 3 shows a baffle of the headphones, the embodiment according to the present invention.

Described first is the baffle 11R with reference to FIG. 3 in which (a) is a perspective view of the baffle 11R to which the speaker unit 16R is attached, (b) is a perspective view of the baffle 11R to which the pad 8R is attached, as shown in FIG. 2, and (c) illustrating the dummy battery container 11Ld for the baffle 11L.

An axis CLH shown in (a) and (b) of FIG. 3 is the axis about which the baffle 11R can be rotated when the right speaker section 1R containing the baffle 11R is being hung by the right hanger section 2R, as shown in (c) of FIG. 1. The axis CLH lies roughly in parallel to the right ear of a user when he or she puts the headphone set 50 on his or her head. The signs UP, DOWN, FRONT, and REAR shown in (a) and (b) of FIG. 3 indicate the orientation of the baffle 11R when the user puts on the headphone set 50.

The baffle 11R is made of thermoplastic resin, such as, ABS resin, in roughly an oval shape in the directions UP and DOWN. The axis CLH lies about the center of the oval shape in the directions UP and DOWN.

Formed around the outer edge of the baffle 11R is a circumferential wall 11Rc. Formed inside the baffle 11R is a protruding round wall 11Re, the center of which is located below the axis CLH. The round wall 11Re has a shape to tightly accept the speaker unit 16R in FIG. 2.

The protruding round wall 11Re has two holes 11Re1 at the outer edge for securing the unit case 12R with the tapping screws NJ in FIG. 2.

Provided in the zone inside the baffle 11R and surrounded by the protruding round wall 11Re are several sound emitting holes 11Rg having a specific size and the microphone container 11Ra, that has a shape like a basket, for containing the microphone 14R, that protrudes in the opposite direction of the protruding round wall 11Re.

Attached to the protruding round wall 11Re is the unit case 12R provided with the speaker unit 16R (FIG. 2) so that the sounds output by the unit 16R are given off to the right ear of a user through the sound emitting holes 11Rg. Provided at the protruding round wall 11Re are a pair of arc-like cutaways 11Re2.

Figure 6:
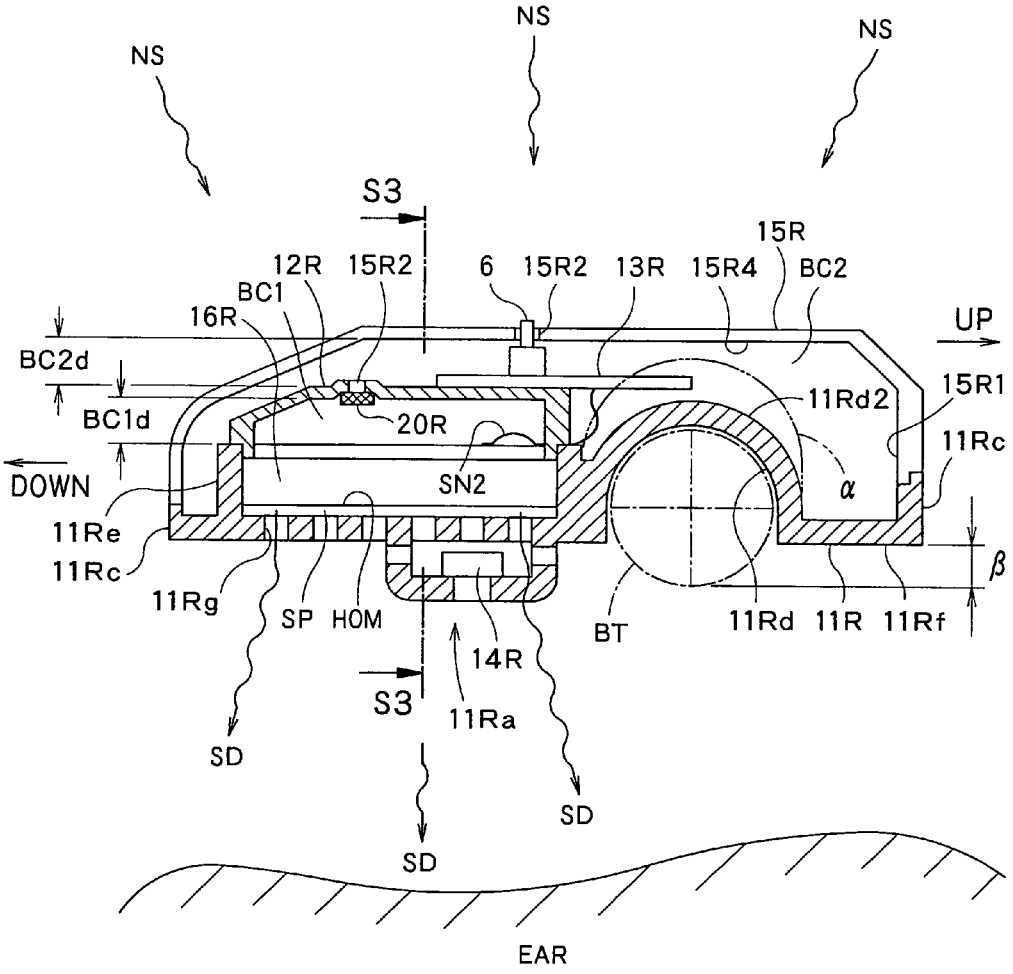
FIG. 6 shows a sectional view illustrating the headphones, the embodiment according to the present invention.

Provided above the protruding round wall 11Re is the battery container 11Rd protruding in the same direction as the wall 11Re and having an arc-like vertical section in the longitudinal direction along the axis CLH. The degree of protrusion of, or a depth dp1 of the battery container 11Rd, indicated in (b) of FIG. 3, is set at a specific level so that a part of the battery BT contained in the container 11Rd protrudes from a surface 11Rf of the baffle 11R, as shown in FIG. 6. This is one requirement for the battery container 11Rd. And, as long as the battery container 11Rd meets this requirement, it does not need to have an arc-like vertical section.

Provided either or both ends of the battery container 11Rd in the longitudinal direction is a terminal hole 11Rd1 that receives a terminal for electrical contact with an electrode of the battery BT contained in the container 11Rd. The terminal hole 11Rd1 is sealed with an adhesive, such as, a silicon sealant, after the terminal is provided.

Six bosses B1 to B6 are provided on the baffle 11R, that protrude in the same direction as the protruding round wall 11Re. The bosses B1 to B4 have through holes through which the tapping screws NJ are inserted to secure the housing 15R in FIG. 2. The bosses B5 and B6 have a bind hole to secure the circuit board 13R with a screw in FIG. 2.

Also provided on the baffle 11R are four pawls 11Rh that protrude in the same direction as the microphone container 11Ra and have protrusions 11Rh1 that face away from each other, as shown in (b) of FIG. 3. The pawls 11Rh are for use in engagement with those of the pad holder 9R, as described later.

Described next with reference to FIG. 4 are the speaker unit 16R and the unit case 12R.

Shown in (a) of FIG. 4 is a perspective view illustrating that the speaker unit 16R is to be attached to the unit case 12R. Shown in (b) of FIG. 4 is a sectional view taken on line S1-S1 of (a) of FIG. 4, illustrating the speaker unit 16R attached to the unit case 12R.

The disc-like speaker unit 16R has a step 16R1 around the outer edge of a rear surface 16R2 that is on the opposite side of the unit 16R with respect to the sound emitting surface HOM. Extending from the rear surface 16R2 are a pair of signal lead wires SN2.

The circular-lid-like unit case 12R, made of thermoplastic resin, such as, ABS resin, has a circumferential wall 12R1 to be in contact with the step 16R1 of the speaker unit 16R. Provided at the wall 12R1 are a pair of arc-like cutaways 12R2 so as to meet the arc-like cutaways 11Re2 of the protruding round wall 11Re shown in (a) of FIG. 3. Also provided at the wall 12R1 is a through hole 12R3 slightly below the center indicated by the intersecting dot lines in (a) of FIG. 4.

The speaker unit 16R is attached to the unit case 12R with the step 16R1 and the circumferential wall 12R1 tightly fixed to each other with an adhesive, with the signal lead wires SN2 extended to the outside of the protruding round wall 11Re through the arc-like cutaways 11Re2 and 12R2. The shape of the arc-like cutaways 11Re2 and 12R2 is designed so that the signal lead wires SN2 are tightly secured when the wires SN2 are extended through holes that are formed when the cutaways 11Re2 and 12R2 meet each other.

Provided on an internal surface 12R4 of the unit case 12R is a sheet 20R that covers a through hole 12R3, to exhibit a certain resistance to incoming air through the through hole 12R3. A recommended material for the sheet 20R is non woven fabrics, such as, Himelon (a trademark of AMBIC Co. Ltd.).

The through hole 12R3 functions as a duct (a sound hole) that communicates a cavity BC1 that is an inner space having direct contact with the speaker unit 16R, as shown in (b) of FIG. 4, and another cavity BC2 that is an outer space via a wall, as shown in FIG. 6. Moreover, as shown in (b) of FIG. 4, the cavity BC1 is provided a tightly closed space except for the through hole 12R3 between the rear surface 16R2 of the speaker unit 16R and the inner surface 12R4 of the unit case 12R.

Figure 5:
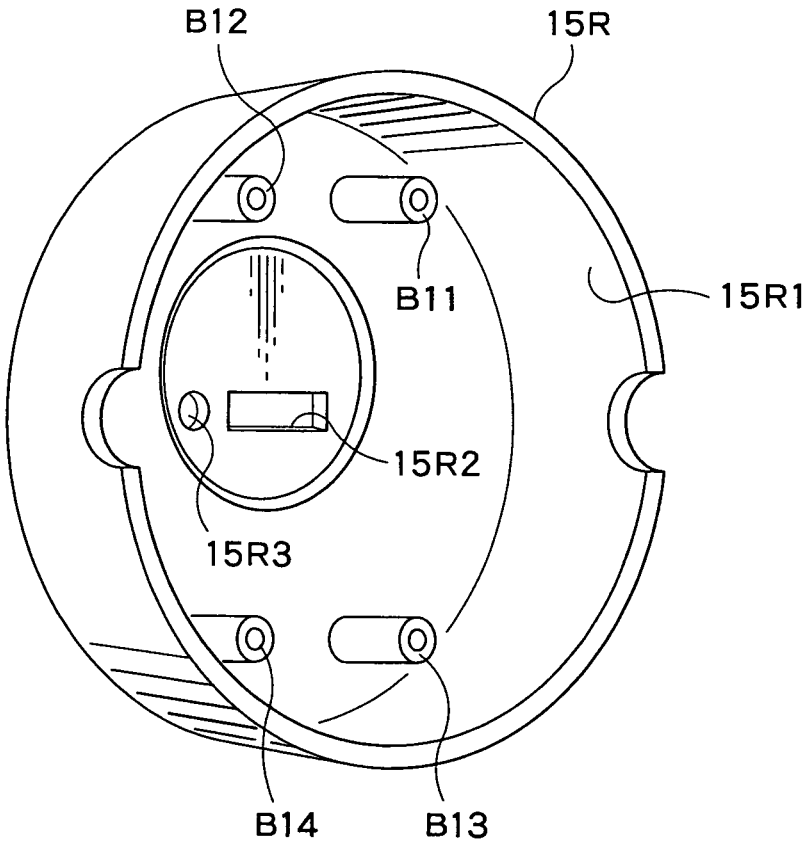
FIG. 5 shows a housing of the headphones, the embodiment according to the present invention.

Described next is the housing 15R with respect to FIG. 5 that is a perspective view showing the internal structure.

The housing 15R is made of thermoplastic resin, such as, ABS resin, shaped like a bowl with an circumference that meets the shape of the baffle 11R shown in FIG. 3. Provided on the circumference of the housing 15R is a circumferential wall 15R1, the edge of which has the size and shape precisely defined so that it meets the circumferential wall 11Rc of the baffle 11R with almost no gaps therebetween in FIG. 2.

Standing in the housing 15R are four bosses B11 to B14 having blind holes to receive the tapping screws NJ through the bosses B1 to B4 of the baffles 11R, shown in (a) of FIG. 3, for securing the housing 15R.

The housing 15R is provided with two openings 15R2 and 15R3 in which the power switch 6 and the LED 7 of the circuit board 13R are fit, respectively, as shown in FIG. 6, although the switch 6 is only shown. The size and shape of the openings 15R2 and 15R3 are precisely defined so that the switch 6 and the LED 7 are tightly secured, after assembled.

Figure 7:
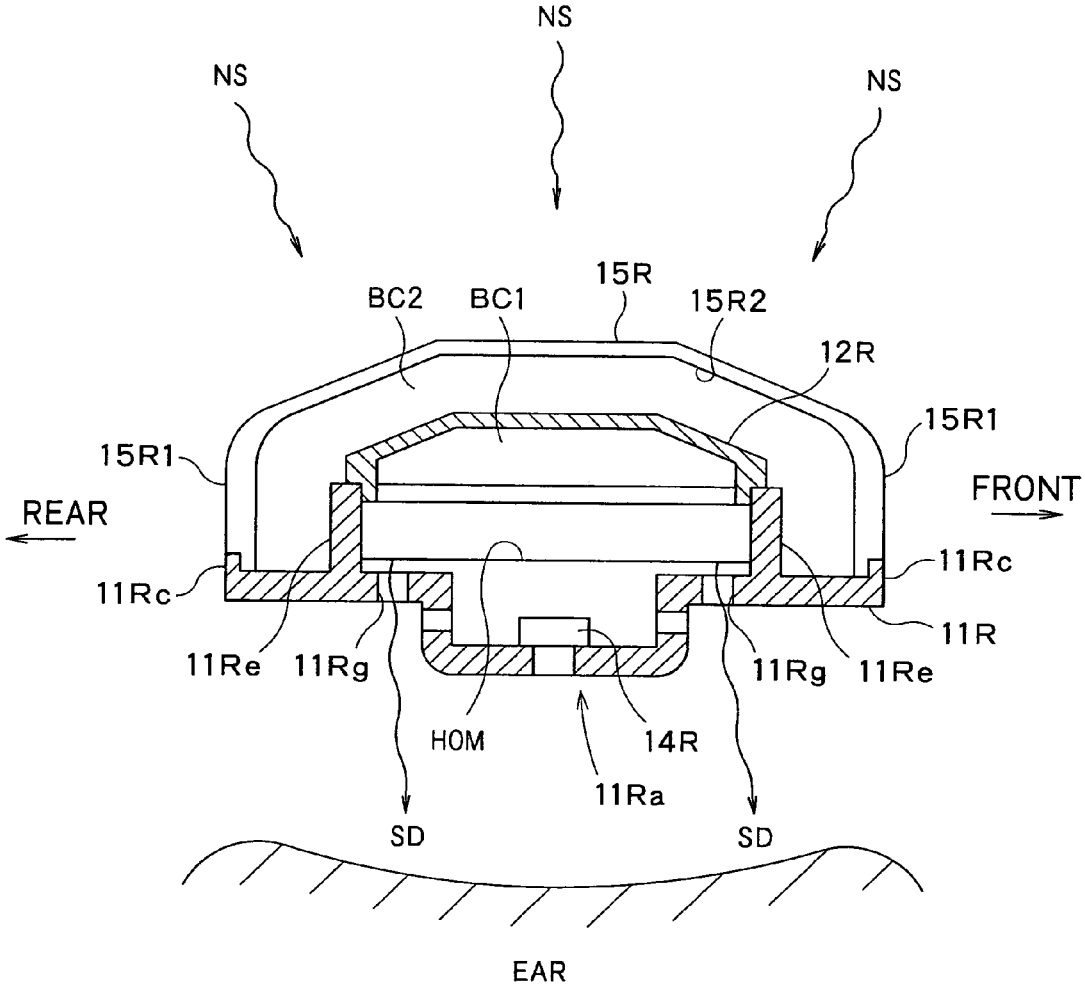
FIG. 7 shows a sectional view illustrating the headphones, the embodiment according to the present invention.

Described next with respect to FIGS. 6 and 7 is the right speaker section 1R that is assembled, as shown in FIG. 2, with the several parts described above.

Especially, described with respect to FIGS. 6 and 7 is a half-assembled right speaker section 1R in which the unit case 12R (having the right speaker unit 16R) and the circuit board 13R are secured to the baffle 11R and also the housing 15R to the baffle 11R to cover the unit case 12R and the board 13R, with the tapping screws NJ.

FIG. 6 is a sectional view taken on line S2-S2 of FIG. 1. FIG. 7 is a sectional view taken on line S3-S3 of FIG. 6. These figures schematically illustrate the half-assembled right speaker section 1R with some parts or portions eliminated for brevity.

The size and shape of the outer surface of the right speaker unit 16R and the inner surface of the protruding round wall 11Re of the baffle 11R are precisely defined so that there is almost no gap therebetween when they are attached to each other.

As already described, the terminal hole 11Rd1, not shown in FIGS. 6 and 7 but in (a) and (b) of FIG. 3, of the battery container 11Rd is sealed with an adhesive, such as, a silicon sealant.

The through holes of the bosses B1 to B4 are stopped up with the tapping screws NJ, as shown in FIG. 2, although not shown in FIGS. 6 and 7.

The space SP, shown in FIG. 6, surrounded by the protruding round wall 11Re, the sound emitting surface HOM of the right speaker unit 16R, and the baffle 11R is closed except for the sound emitting holes 11Rg that are the only openings of the baffle 11R.

When it comes to the left speaker section 1L, with the basically similar structure as shown in FIGS. 6 and 7, the space (the counterpart of the space SP discussed above), is provide with the hole for the jack 4, which is closed with a wall formed with the baffle 11L and housing 15L so that the hole for the jack 4 dose not communicate with the cavity (the counterpart of the cavity BC1 or BC2), in addition to the sound emitting holes (the counterpart of the holes 11Rg).

In the right speaker section 1R, the cavity BC1 is provided at the rear surface 16R2 side of the speaker unit 16R, as shown in (b) of FIG. 4, and is tightly closed by the unit case 12R except for the through hole 12R3 covered with the sheet 20R. The cavity BC2 is provided a tightly enclosed space between the unit case 12R and an internal surface 15R4 of the housing 15R in FIG. 6.

Discussed next is listening to sounds SD given off through the sound emitting holes 11Rg by an ear EAR of a user.

The user can, off cause, directly listen to the sounds from the right speaker unit 15R. Different from these sounds, all of or most part of ambient noises NS generated outside the housing 15R reach the ear EAR through the sound emitting holes 11Rg via the housing 15R, the cavity BC2, and the unit case 12R. There is no passage for the ambient noises NS from the outside of the housing 15R to the ear EAR through the sound emitting holes 11Rg. The noises SN pass at least two walls to reach the ear EAR: the first wall that is the circumferential wall 11Rc of the baffle 11R or the wall of the housing 15R; and the second wall that is the protruding round wall 11Re of the baffle 11R or the wall of the unit case 12R, referred to as a dual-wall structure, hereinafter. The ambient noises SN are effectively attenuated with the dual-wall structure.

In FIG. 6, the protruding round wall 11Re, the sound emitting surface HOM of the right speaker unit 16R, and the baffle 11R provide the space SP.

An alternative to this dual-wall structure is that the surface HOM is tightly attached to the inner surface of the baffle 11R with no space SP, as shown in FIG. 8. In the alternative, all of or most part of the ambient noises NS pass: the first wall that is the circumferential wall 11Rc of the baffle 11R or the wall of the housing 15R; and the second wall that is the protruding round wall 11Re of the baffle 11R or the wall of the unit case 12R; and also the speaker unit 16R. The ambient noises SN are more effectively attenuated with the alternative structure.

Although the overhead-type headphones can accommodate a larger housing than the inner-ear type, the smaller the better for the speaker units as long as they can offer a high sound quality. Nevertheless, it is known that the difference in volume of the cavity or shape of the cavity even though at the same volume varies the reproduction frequency characteristics.

In order to avoid the problem on the reproduction frequency characteristics, the left speaker section 1L of the headphone set 50 is equipped with the dummy battery container 11Ld that has the same shape as the container 11Rd of the right speaker section 1R, as shown in (c) of FIG. 3, with cavities BC1 and BC2 with the same shape and volume as those of the section 1R.

The roughly symmetrical structure between the left and right speaker sections 1L and 1R offers high-quality sounds with almost the same reproduction frequency characteristics.

In the roughly symmetrical structure, the dummy battery container 11Ld on the baffle 11L of the left speaker section 1L is equipped with a rib 11Ld1, as shown in (c) of FIG. 3, to avoid erroneous installation of a battery, with no terminal hole like the hole 11Rd1 in the right speaker section 1R, as shown in (a) and (b) of FIG. 3.

To increase the volume of the cavity BC2 without increasing the size of the housing 15R, the position of the battery container 11Rd is adjusted so that a part of the battery BT contained in the container 11Rd protrudes from the surface 11Rf of the baffle 11R by a degree of protrusion β in FIG. 6. The battery BT is held by a pad holder 9R shown in FIG. 10, which will be discussed later.

The adjustment to the position of the battery container 11Rd described above allows the battery BT to be located outside (below in FIG. 6) a position α for the container 11Rd to be located when such an adjustment is not made, thus increasing the cavity BC2 compared to when the battery BT is completely contained in the housing 15R with no such an adjustment. This adjustment is also applied to the dummy battery container 11Ld in the left speaker section 1L even though no battery is installed.

Accordingly, the headphone set 50 according to the present invention can offer higher-quality sounds than other headphones with the same speaker housing size.

The battery-container position adjustment gives the battery container 11Rd a shallow concave towards the housing 15R, thus offering a smaller or thinner speaker section. This is evident from FIG. 6 in that the container 11Rd interferes with the circuit board 13R when it is located at the position α.

The battery BT used for the headphone set 50 may not only be a AAA dry battery, but also another type of dry battery, such as D, C, AA, or N in the I.E.C. standards, or any types of rechargeable battery or button cell, etc.

No matter what type of battery or cell is used, the headphone set 50 according to the invention has the following requirements on the battery container 11Rd.

As shown in FIG. 6, the battery container 11Rd has the concave for containing the battery BT on the surface 11Rf of the baffle 11R (the surface 11Rf receives the pad 8R in FIG. 2). The battery container 11Rd is positioned so that a part of the battery BT contained in the container 11Rd protrudes from the surface 11Rf of the baffle 11R. The battery BT is held by the pad holder 9R (FIG. 10) so that it is secured in the battery container 11Rd.

The headphone set 50 according to the invention may have the following sizes:

The left and right speaker sections 1L and 1R: 72 mm, 60 mm, and 15 mm in the longitudinal, transversal, and width directions, respectively, in the outer appearance; and The right speaker unit 16R: ϕ40 mm in outer diameter.

Described next is the ear pads 51 attached to the left and right baffles 11L and 11R, as shown in FIG. 1.

The ear pads 51 have the same size and structure in the left and right speaker sections 1L and 1R. Thus, described below is only the ear pad 51 for the right speaker section 1R.

Figure 9:
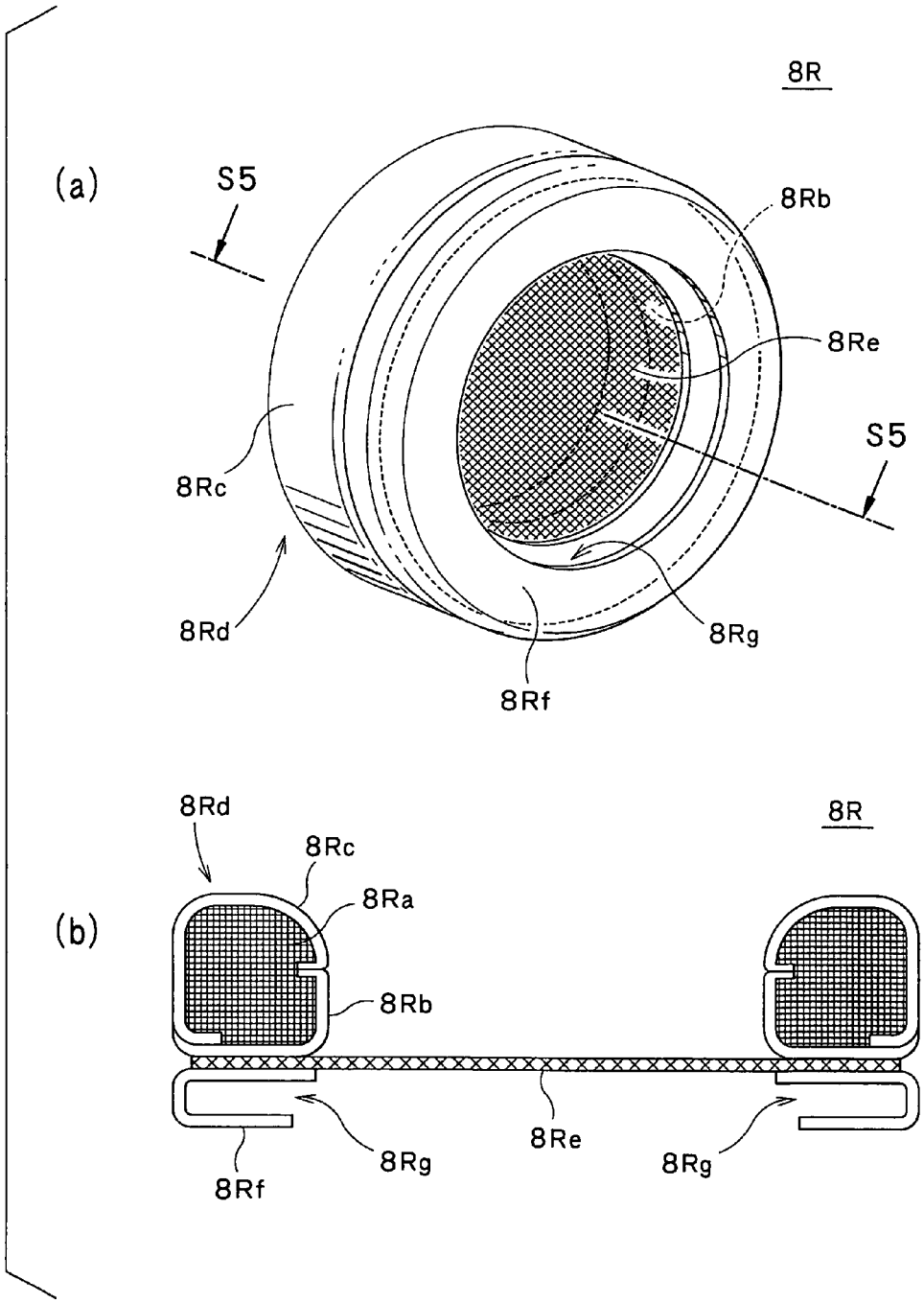
FIG. 9 shows views illustrating a pad of the headphones, the embodiment according to the present invention.

Shown in (a) of FIG. 9 is a perspective view of the pad 8R when looked from the baffle 11R side in FIG. 2. Shown in (b) of FIG. 9 is a sectional view of the pad 8R taken on line S5-S5 of (a) of FIG. 9.

The pad 8R consists of: a pad body 8Rd having a sponge material 8Ra covered with a sheet 8Rb and resin leather 8Rc about by half for each in section, as shown in (b) of FIG. 9; a dustproof net 8Re attached to the pad body 8Rd by fusion to close the center opening; and a flat 8Rf attached to the dustproof net 8Re by fusion.

The dustproof net 8Re is a fine net that prevents dust from entering the pad 8R but allows sounds to enter freely. The flap 8Rf has a "U"-shaped section over the pad body 8Rd via the dustproof net 8Re, with a space 8Rg, as shown in (b) of FIG. 9.

The sponge material 8Ra is made, for example, of low-foamed uretan foam. The sheet 8Rb and the frap 8Rf are made of, for example, a polyuretan (PU) sheet. The resin leather 8Rc is made of, for example, protein leather (a trademark of Idemitsu Kosan Co., Ltd.). The dustproof net 8Re is made of, for example, nylon.

Described next is the pad holder 9R with reference to FIG. 10. The pad holder 9R is flat, as shown in (b) of FIG. 10, and made of, for example, poly acetal (POM) resin.

The pad holder 9R is equipped with pawls 9R1 to be engaged with the pawls 11Rh of the baffle 11R shown in (b) of FIG. 3 when the holder 9R is attached to the baffle 11R in FIG. 2.

Moreover, the pad holder 9R is equipped with an opening 9R2 that is provided in the same position as the sound emitting surface HOM of the speaker unit 16R shown in (a) of FIG. 3 when the pad holder 9R is attached to the baffle 11R in FIG. 2.

Provided on the surface of the pad holder 9R on which the pawls 9R1 are formed are a pair of ribs 9R3 having a height enough for almost touching the battery BT contained in the battery container 11Rd with a slight gap therebetween when the holder 9R is attached to the baffle 11R in FIG. 2.

With the structure described above, the pad holder 9R functions as a holder or a lid so that the battery BT is secured in the battery container 11Rd. The pad holder 9R thus allows a smaller number of parts for the headphone set 50 because no dedicated battery cover or lid is required, which leads to cost down.

Figure 10:
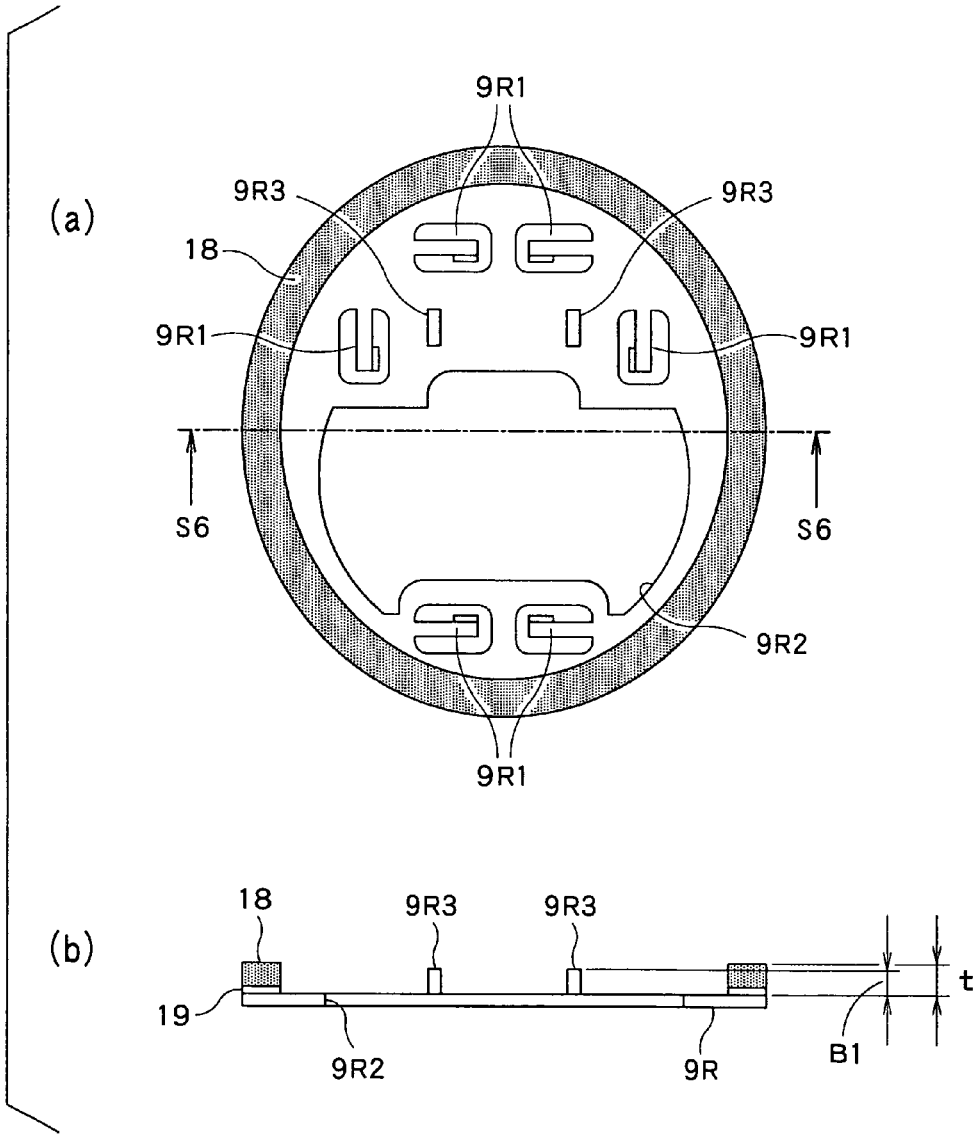
FIG. 10 shows views illustrating a pad holder of the headphones, the embodiment according to the present invention.

Provided around the pad holder 9R is a sound-insulating ring 18, as shown in (a) of FIG. 10. The ring 18 is made of an elastic material, such as, uretan foam, fixed to the holder 9R with a double-sided tape 19, as shown in (b) of FIG. 10. The signs "t" and "β1" indicate the thickness of the ring 18 and the height of the ribs 9R3, respectively, in (b) of FIG. 10.

Figure 11:
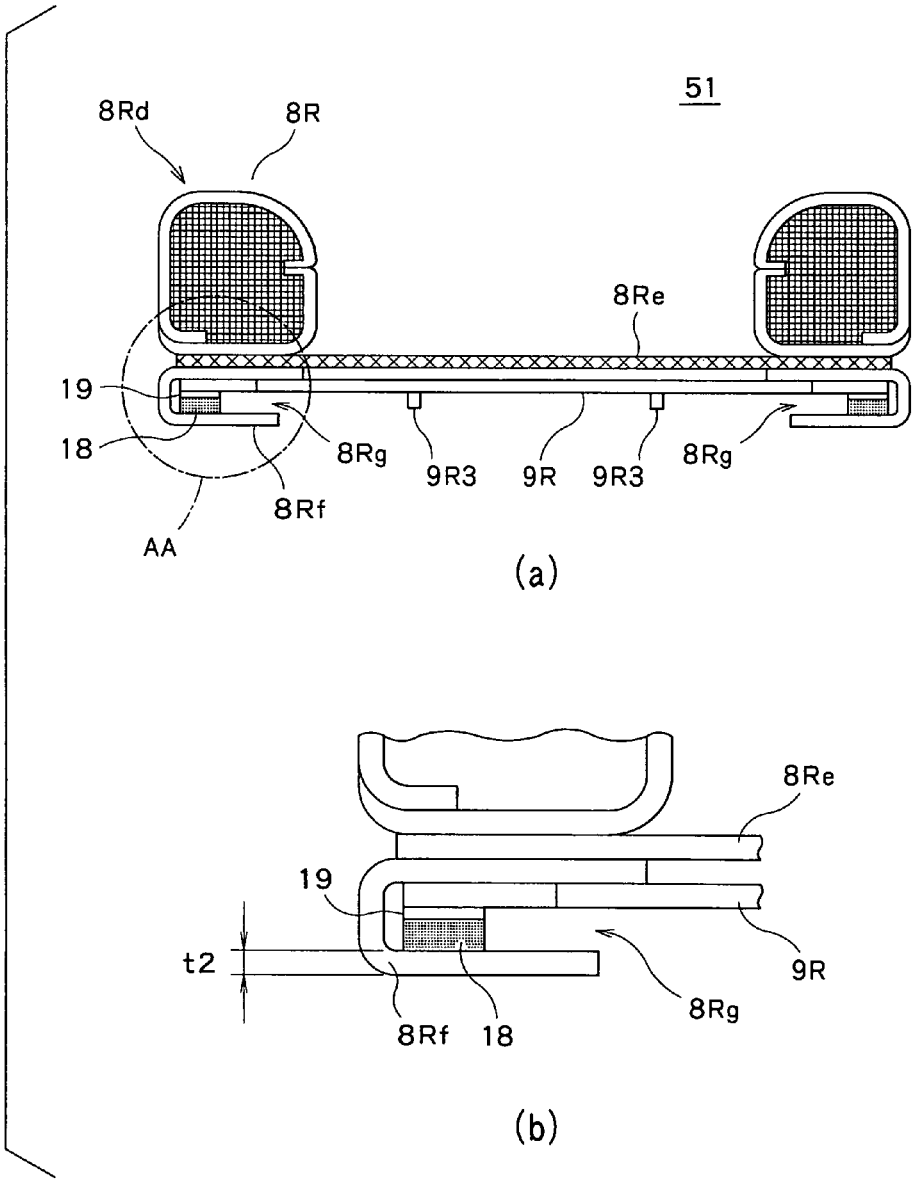
FIG. 11 shows views illustrating an ear pad of the headphones, the embodiment according to the present invention.

Shown in FIG. 11 are sectional views for the pad 8R attached to the pad holder 9R, in which the sound-insulating ring 18 of the pad holder 9R is inserted into the space 8Rg of the pad 8R in the baffle 11R side, or the lower side in (a) of FIG. 11. The ring 18 is inserted into the space 8Rg while the flap 8Rf of the pad 8R is being deformed or turned over. The flap 8Rf has a thickness "t2" as shown in (b) of FIG. 11 which is an enlarged details of the section AA shown in (a) of FIG. 11.

Figure 12:
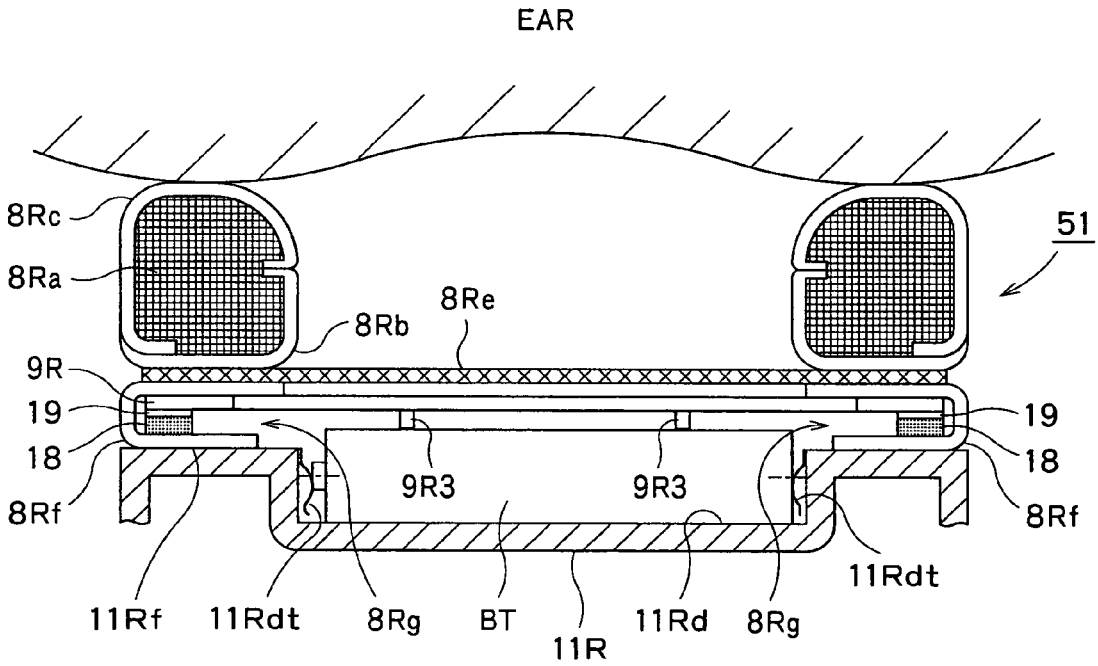
FIG. 12 shows a view illustrating a feature of the structure of the headphones, the embodiment according to the present invention.

Illustrated in FIG. 12 is the ear pad 51 having the pad 8R held by the pad holder 9R is attached to the baffle 11R, with the battery BT installed in the battery container 11Rd with terminals 11Rdt.

The baffle 11R and the pad holder 9R are coupled to each other with a positional relationship described below by the engagement of the pawls 11Rh and the pawls 9R1.

The sound-insulating ring 18 is squashed a little bit in the thickness direction so that the flap 8Rf of the pad 8R sandwiched by the surface 11Rf of the baffle 11R and the ring 18 tightly touches the surface 11Rf.

The ribs 9R3 are positioned so that their heads almost touch the battery BT contained in the battery container 11Rd, as already described, so that the battery BT is firmly secured in the container 11Rd.

The several factors, the degree of protrusion β for the battery BT in FIG. 6, the thickness "t" of the sound-insulating ring 18 before assembly in (b) of FIG. 6, the thickness "t2" of the flap 8Rf in (b) of FIG. 11, and the height "β1" of the ribs 9R3 in (b) of FIG. 10, are set so as to satisfy the relation $\beta+\beta 1<t+t2$.

Moreover, the factors are set so as to satisfy the relation $\beta+\beta 1\cong t-\Delta t+t2$ for the sound-insulating ring 18 to be crushed by a degree Δt so that the pad holder 9R is tightly attached to the baffle 11R.

In this embodiment, t=2 mm, t2=0.5 mm, β=1 mm, β1=1.1 mm, Δt=75%, and a gap=0.1 mm between the battery BT and the ribs 9R3 offer excellent tightness and battery holding performance, with the relation $\beta+\beta 1+0.1=0.75+t2$.

The ear pad 51 having the pad 8R held by the pad holder 9R and attached to the baffle 11R is easily detached therefrom by disengaging the pawls 9R1 in (a) of FIG. 10 and the pawls 11Rh in (b) of FIG. 3 with a force to separate the ear pad 51 and the baffle 11R from each other. The battery BT can be easily replaced by a new one with this simple detaching mechanism.

As described, the sound-insulating ring 18 is provided around the pad holder 9R, as shown in (a) of FIG. 10, and is inserted into the space 8Rg of the flap 8Rf of the pad 8R so that ring 18 is pressed onto the baffle 11R via the flap 8Rf, as shown in (a) of FIG. 11, although the baffle 11R is not shown but exists in the lower side in (a) of FIG. 11.

This structure offers several advantages as discussed below.

The sound-insulating ring 18 is not exposed because it is inserted into the space 8Rg of the flap 8Rf so that it is enclosed by the flap 8Rf. This structure gives the ring 18 an extremely high sound insulation performance, which is discussed in comparison with a known headphone set with reference to FIG. 13.

Figure 13:
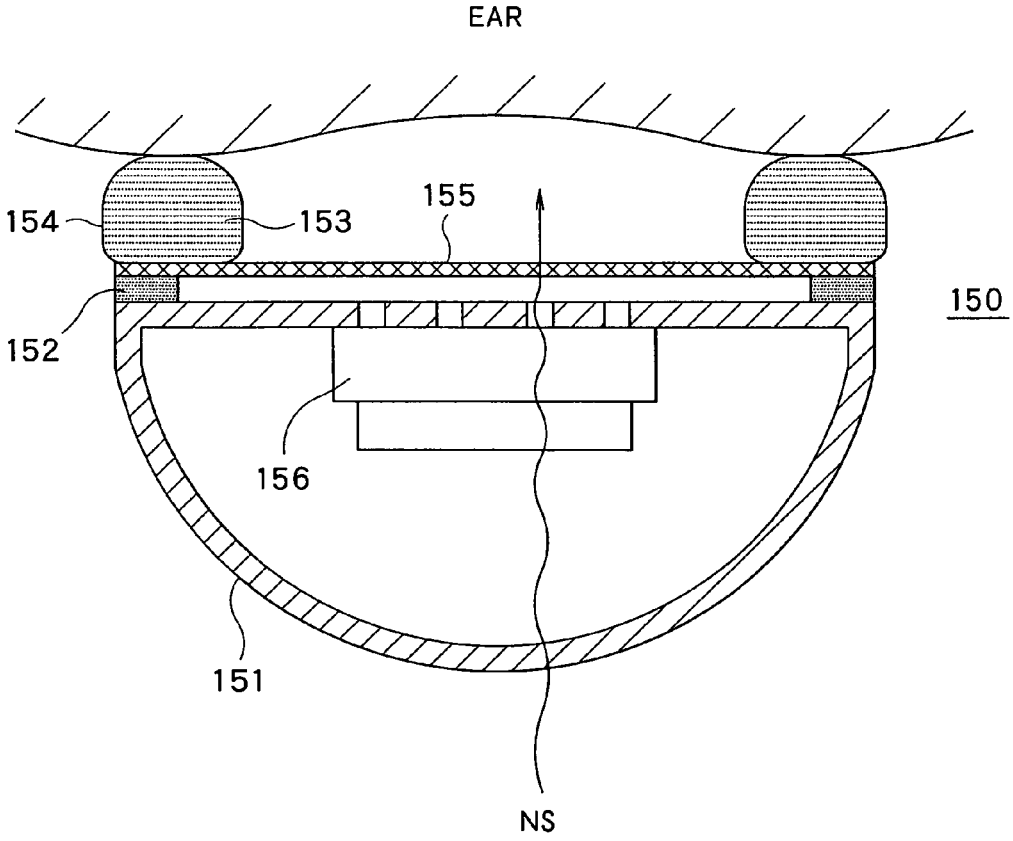
FIG. 13 shows a view illustrating the structure of known headphones.

The Known headphone set 150 shown in FIG. 13 is equipped with a sound-insulating ring 152 on a surface of a housing 151. Fixed to the housing 151 with an engaging means (not shown) is a ring pad 154 with a polyuretan material 153 contained therein and provided with a dust-proof net 155 that covers the center opening. The sound-insulating ring 152 is crushed a little bit between the pad 154 and housing 151 to enhance the tightness therebetween. The ring 152 is exposed or can be seen from outside.

The sound-insulating ring 18 is this embodiment is also made of an elastic material for enhancing the tightness. Such an elastic material may be polyuretan foam which is, however, not excellent in sound insulation performance due to its foamed structure. For higher sound insulation performance than the known headphones 150, the sound-insulating ring 18 is inserted into the space 8Rg of the flap 8Rf so that it is enclosed by the flap 8Rf made of, for example, a PU sheet that is comparatively excellent in sound insulation performance.

Moreover, the sound-insulating ring 18 is enclosed by the flap 8Rf without exposed to outside so that it is not damaged by ultraviolet rays, thus can exhibit a higher sound insulation performance for a long time.

A foamed polyuretan material has a difficulty in showing good appearance which is a disadvantage when a sound-insulating ring is exposed or can be seen from outside, like the ring 152 of the known headphones 150.

On the other hand, in the headphone set 50 (the embodiment of the present invention), the PU sheet 8Rb and the resin leather 8Rc can be seen from outside without exposing the sound-insulating ring 18, as shown in FIGS. 9 to 11, thus the present invention allows high-class appearance design.

As discussed above, the headphone set 50 restricts ambient noises from entering the ear pad 51, thus exhibiting a high sound insulation performance.

The combination of the sound-insulating structure of the ear pad 51 and the dual-wall sound-insulating structure of the speaker sections 1L and 1R exhibits a higher sound insulation performance than either of the individual structures.

Figure 14:
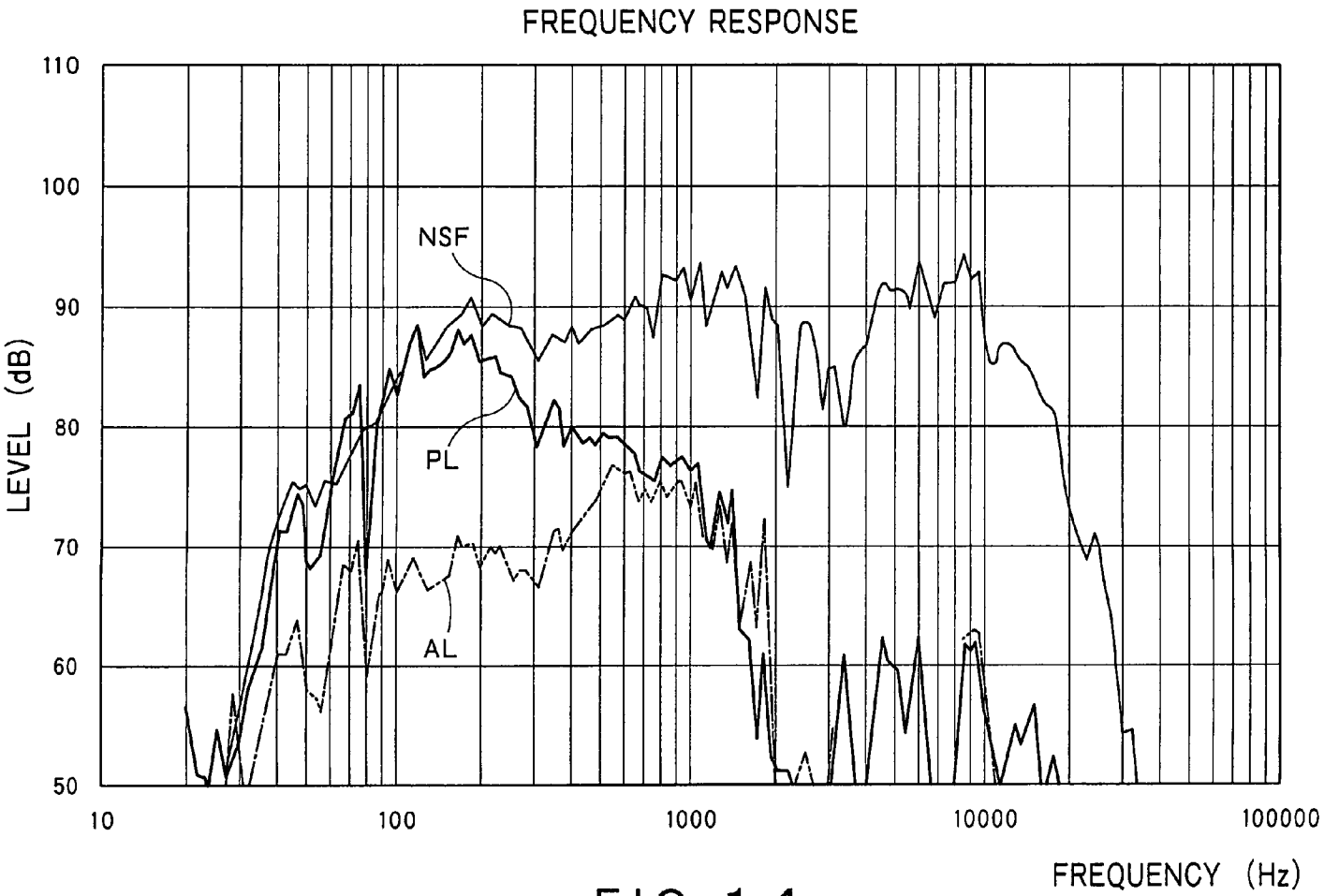
FIG. 14 shows a graph indicating frequency response of the headphones, the embodiment according to the present invention.
Figure 15:
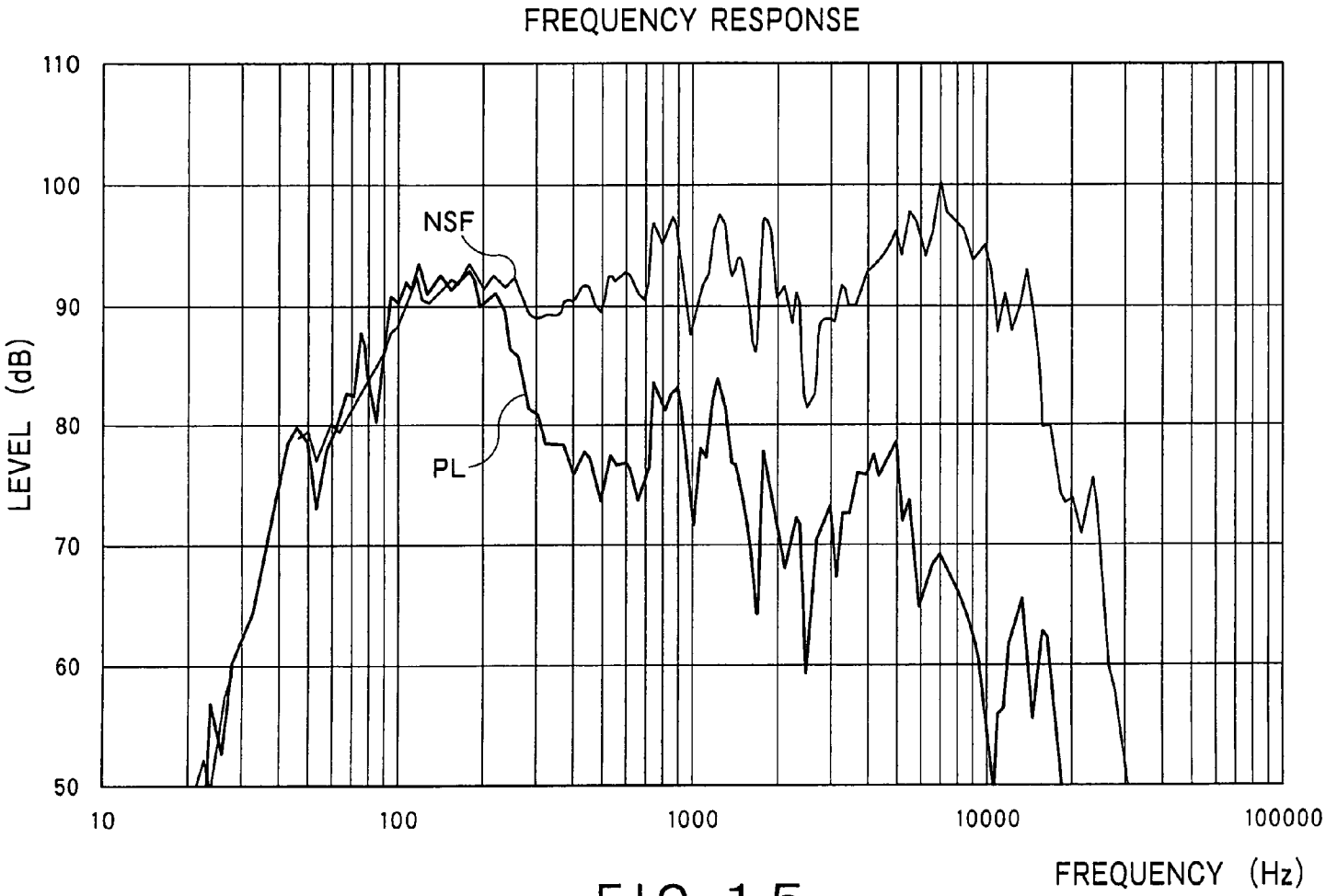
FIG. 15 shows a graph indicating frequency response of the known headphones for comparison with the embodiment according to the present invention.

Discussed next with reference to FIGS. 14 and 15 is the sound insulation performance of the headphone set 50 compared to the known headphone set 150. FIGS. 14 and 15 show the frequency response of the headphone sets 50 and 150, respectively.

The known headphone set 150 is the feedback-type noise-canceling headphones, like the headphone set 50 of the embodiment. However, the known headphone set 150 has the following structures different from the embodiment: a single-wall housing 151 in which a speaker unit 156 is housed in a single space or cavity, thus ambient noises NS easily reach the speaker unit 156; and the sound-insulating ring 152 that can be seen from outside, as shown in FIG. 13.

Indicated in FIGS. 14 and 15 are: ambient-noise frequency response NSF; sound level PL in a passive mode in which the ambient-noise reduction function is inactive; and sound level AL (only in FIG. 14) in an active mode in which the ambient-noise reduction function is active.

FIGS. 14 and 15 teach that compared to the known headphone set 150, in the headphone set 50 of the embodiment, ambient noises are drastically reduced in a range from 1,000 Hz to 10,000 HZ in the passive mode. This shows high performance of the sound-insulating structure of the ear pad 51 and the dual-wall sound-insulating structure of the speaker sections 1L and 1R.

It is known that the ambient-noise reduction function works excellently in the lower frequency range, which is shown in FIG. 14.

Also shown in FIG. 14 is that, in addition to the ambient-noise reduction function, the sound-insulating structure of the ear pad 51 and the dual-wall sound-insulating structure of the speaker sections 1L and 1R exhibit excellent ambient-noise reduction performance.

As shown in FIG. 6, in the embodiment, the battery container 11Rd is provided so that the battery BT is installed outside the cavities BC1 and BC2. If the battery BT is installed inside the cavities BC1 and/or BC2, the capacity of these cavities is different between the left and right speaker sections 1L and 1R, and hence the sound quality is different between the sections 1L and 1R. Because the battery BT is installed either the left or the right speaker section for the low-power consuming noise-canceling circuitry. Installation of the battery BT outside the cavities BC1 and BC2 in the embodiment offers almost uniform sound quality between the left and right speaker sections 1L and 1R.

The through hole, or the duct 12R3, shown in FIG. 6, that connects the cavities BC1 and BC2 is designed as having a diameter that gives appropriate reproduction frequency characteristics depending on the cavities BC1 and BC2 and then the right speaker section 1R, the thickness, the material, etc., of the sheet 20R depending on the duct 12R3, which is also applied to the left speaker section 1L.

It is preferable that the cavities BC1 and BC2 have the equal length in the direction orthogonal to the rear surface 16R2 (FIG. 4) of the right speaker section 1R. Or, it is preferable that the difference in distances BC1*d* and BC2*d* (FIG. 6) in the cavities BC1 and BC2, respectively, becomes smaller. The longer distance BC1*d* but the shorter distance BC2*d*, or vise versa, affect the ambient-noise reduction performance.

It is understood by those skilled in the art that the forgoing description is a preferred embodiment of the present invention and that various changes and modifications may be made in the invention without departing from the spirit and scope thereof.

For example, the cavities BC1 and BC2 shown in FIG. 6 may not be tightly sealed, although this is the best mode. They may have an opening of, for example, about ϕ3 mm, for the speaker sections of about 50 mm to 60 mm in outer diameter, which allows sufficient sound insulation performance in spite of some effects to the sound quality and sound insulation characteristics.

The headphone set 50 of the embodiment is the noise-canceling type. The present invention is, however, be applicable to other types of headphones, such as, those with no batteries, those with batteries but not the noise-canceling type, etc. The headphones with batteries but not the noise-canceling type are, for example, wireless headphones, surround headphones and radio-equipped headphones. The present invention is also applicable to so-called ear headphones with no headbands.

The noise-reducing circuitry may at least be installed in either the left speaker section 1L or the right speaker section 1R.

As disclosed above in detail, the present invention provides headphones that exhibit a high sound insulation performance to effectively reduce ambient noises.

What is claimed is:

1. A headphone set comprising at least one speaker section, the speaker section including:

a baffle having a front surface and a rear surface, and at least one sound emitting hole penetrating through the front and rear surfaces;

a surrounding wall formed on the rear surface of the baffle so that the surrounding wall protrudes from the rear surface of the baffle in a direction opposite to the front surface of the baffle and surrounds the sound emitting hole on the rear surface of the baffle;

a speaker unit installed on the rear surface of the baffle so that the speaker unit is tightly surrounded by the surrounding wall on the rear surface of the baffle and having a front sound-emitting surface that faces the sound emitting hole and having a rear surface;

a unit case that touches a protruding end of the surrounding wall, the rear surface of the speaker unit being covered by the unit case and surrounded by the surrounding wall on the rear surface of the baffle such that a first cavity is enclosed by the unit case, the surrounding wall and the rear surface of the speaker unit;

a housing that touches the rear surface of the baffle to cover the unit case such that a second cavity is enclosed by the housing, the unit case, the surrounding wall, and the baffle, the second cavity being positioned so as to cover the first cavity between the housing and the baffle, with the unit case being positioned between the first and second cavities; and a microphone having a front sound-receiving surface and a rear surface, the rear surface of the microphone and the front sound-emitting surface of the speaker unit facing each other within the surrounding wall.

2. The headphone set according to claim 1, wherein the speaker section includes:

a circuit board that functions with a power supplied by a battery; and a container for containing the battery, the container being formed on the baffle.

3. The headphone set according to claim 2, wherein the container is provided so that a part of the battery protrudes from the baffle in a direction opposite of the surrounding wall that protrudes from the baffle, when the battery is contained in the container.

4. The headphone set according to claim 3 further comprising an ear pad having a pad and a pad holder to hold the pad, the ear pad being attached to the baffle so that the pad holder almost touches the part of the battery that protrudes from the baffle, when the battery is contained in the container.

5. The headphone set according to claim 1 further comprising a further speaker section, the further speaker section including:

a baffle having a front surface and a rear surface, and at least one sound emitting hole penetrating through the front and rear surfaces;

a surrounding wall formed on the rear surface of the baffle so that the surrounding wall protrudes from the rear surface of the baffle in a direction opposite to the front surface of the baffle and that surrounds the sound emitting hole on the rear surface of the baffle;

a speaker unit installed on the rear surface of the baffle so that the speaker unit is tightly surrounded by the surrounding wall on the rear surface of the baffle, the speaker unit having a front sound-emitting surface that faces the sound emitting hole and having a rear surface;

a unit case that touches a protruding end of the surrounding wall, the rear surface of the speaker unit being covered by the unit case and surrounded by the surrounding wall on the rear surface of the baffle, such that a first cavity is enclosed by the unit case, the surrounding wall and the rear surface of the speaker unit;

a housing that touches the rear surface of the baffle to cover the unit case such that a second cavity is enclosed by the housing, the unit case, the surrounding wall, and the baffle, the second cavity being positioned so as to cover the first cavity between the housing and the baffle, with the unit case being positioned between the first and second cavities; and a microphone having a front sound-receiving surface and a rear surface, the rear surface of the microphone and the front sound-emitting surface of the speaker unit facing each other within the surrounding wall, wherein:

at least either of the speaker section and the further speaker section includes a circuit board that functions with a power supplied by a battery, and the speaker section and the further speaker section include a first concave section and a second concave section, respectively, each concave section being formed on the front surface of the baffle, each concave section being not communicated with the first and second cavities and being curved down in a direction in which the surrounding wall protrudes from the baffle, a shape and size of the first and second cavities being identical between the speaker section and the further speaker section, and a shape and size of the first and second concave sections being identical to each other.

6. The headphone set according to claim 5, wherein the first concave section contains the battery whereas the second concave section has means to avoid installation of the battery therein.

* * * * *